US005921499A

United States Patent [19]

Forsner

[11] Patent Number: 5,921,499

[45] Date of Patent: Jul. 13, 1999

[54] TOOL FOR A DISPOSABLE DRUM

[75] Inventor: Bo Forsner, Österskär, Sweden

[73] Assignee: Ulvator AB, Stockholm, Sweden

[21] Appl. No.: 08/981,069

[22] PCT Filed: May 30, 1996

[86] PCT No.: PCT/SE96/00696

§ 371 Date: Dec. 16, 1997

§ 102(e) Date: Dec. 16, 1997

[87] PCT Pub. No.: WO96/41762

PCT Pub. Date: Dec. 27, 1996

[30] Foreign Application Priority Data

Jun. 12, 1995 [SE] Sweden ..... 9502119

[51] Int. Cl.[6] ..... B65H 75/14; B65H 75/18

[52] U.S. Cl. ..... 242/608.3; 242/599.4; 242/609.1

[58] Field of Search ..... 242/599.4, 599, 242/599.1, 597.6, 611.2, 608.3, 609.1, 608.7, 129.6, 129.62

[56] References Cited

U.S. PATENT DOCUMENTS

| | | | |
|---|---|---|---|
| 1,473,678 | 11/1923 | Holmquist | 242/608.3 |
| 1,946,764 | 2/1934 | Schaub | 242/611.2 |
| 2,306,907 | 12/1942 | Stahl . | |
| 3,540,670 | 11/1970 | Rissberger | 242/611.2 |
| 3,652,026 | 3/1972 | Awebro . | |
| 3,704,838 | 12/1972 | Bernier et al. | 242/608.3 |
| 4,412,661 | 11/1983 | Wise et al. | 242/611.2 |
| 4,702,429 | 10/1987 | Black | 242/608.3 |
| 4,976,475 | 12/1990 | Bjorkqvist . | |
| 5,400,567 | 3/1995 | Lindstrand . | |
| 5,417,384 | 5/1995 | Lindstrand . | |

FOREIGN PATENT DOCUMENTS

| | | |
|---|---|---|
| 379747 | 7/1935 | Germany . |
| 339 368 | 10/1971 | Sweden . |
| WO 92/21603 | 12/1992 | WIPO . |

*Primary Examiner*—John M. Jillions
*Attorney, Agent, or Firm*—Nixon & Vanderhye P.C.

[57] ABSTRACT

A tool for assembly on a drum to form a rotatable unit, to be placed in journalling equipment for rotation of the unit, is provided. The drum comprises a cylindrical sleeve and two end pieces and is designed to carry a coil of a flexible object, such as cable. The tool has two support and bearing elements, each with a hub, a plurality of support arms and a concentric support member for centering the drum; a connecting member having a shaft extending through the sleeve and the hubs; and an anchor for anchoring the support and bearing elements to the shaft while at the same time securing the sleeve against axial displacement in relation to the shaft. The support arms are positioned to abut the end pieces and have free ends located radially inside the outer circular edge of the end pieces so that the support arms are not in contact with the ground when the unit is resting on the ground by engagement of the end pieces of the drum with the ground.

21 Claims, 17 Drawing Sheets

TOOL FOR A DISPOSABLE DRUM

The present invention relates to a tool for detachable assembly on a drum of disposable type to form a rotatable unit to be placed in journalling equipment for rotation of the unit, said drum comprising a cylindrical sleeve and two end pieces which are secured to the sleeve to prevent them from slipping axially towards each other, the drum being designed to carry a coil of a continuous flexible object, comprising cable, line, wire, wire cable, rope, cord, ribbon, chain or the like, said tool comprising two support and bearing elements, each having a hub-forming sleeve, a plurality of support arms rigidly joined to the hub and forming right angle or substantially right angle with the central axis of the hub, and a concentric support member for supporting and centering the drum by means of internal engagement with both end portion of the sleeve; and also a connecting member comprising a shaft arranged to extend through the sleeve and said hubs, and anchoring means for anchoring the support and bearing elements to said shaft while at the same time securing the sleeve against axial displacement in relation to the shaft. The invention also relates to a drum of disposable type for assembly with a tool of the type described, and the combination of drum and tool of the type described.

SE-468 129 (9101042-1) describes a new method of manufacturing, packing, distributing and using a coil of a continuous flexible object, such as a cable, through which method the conventional, returnable wooden drums and the many drawbacks entailed with their use are eliminated, and valuable advantages and plus effects are achieved throughout the chain of handling from producing the coil to uncoiling the cable, etc. on site and even, where relevant, to recovery of a scrap line. Said patent also describes a tool for use with this method, which tool has two support wheels designed to clamp between them a sleeve for said coil and designed to be in contact with the ground when the tool is to be fitted onto an empty sleeve and on a finished parcel of the coil and after the coil has been produced. In order to give the coil lateral protection the sleeve is provided with two protective rings having smaller diameter than said support wheels so that they do not come into contact with the ground.

The object of the present invention is to produce a tool for use in the described manner, which is simpler to handle and simpler to assemble to and dismantle from a sleeve, as well as having low weight and thus being cheaper to manufacture.

It is also an object of the invention to produce a drum of disposable type which is simple to manufacture and which enables the use of a tool to be fitted to the drum to form a rotatable unit that is simpler to manufacture and simpler and lighter to use.

The tool according to the invention is characterized in that the support arms are arranged to abut in supporting manner against the end pieces and have free ends located radially inside the outer circular edge of the end pieces so that the support arms are not in contact with the ground when said unit is resting on the ground by means of the end pieces of the drum.

The invention is described in more detail in the following with reference to the drawings.

Figure 1:
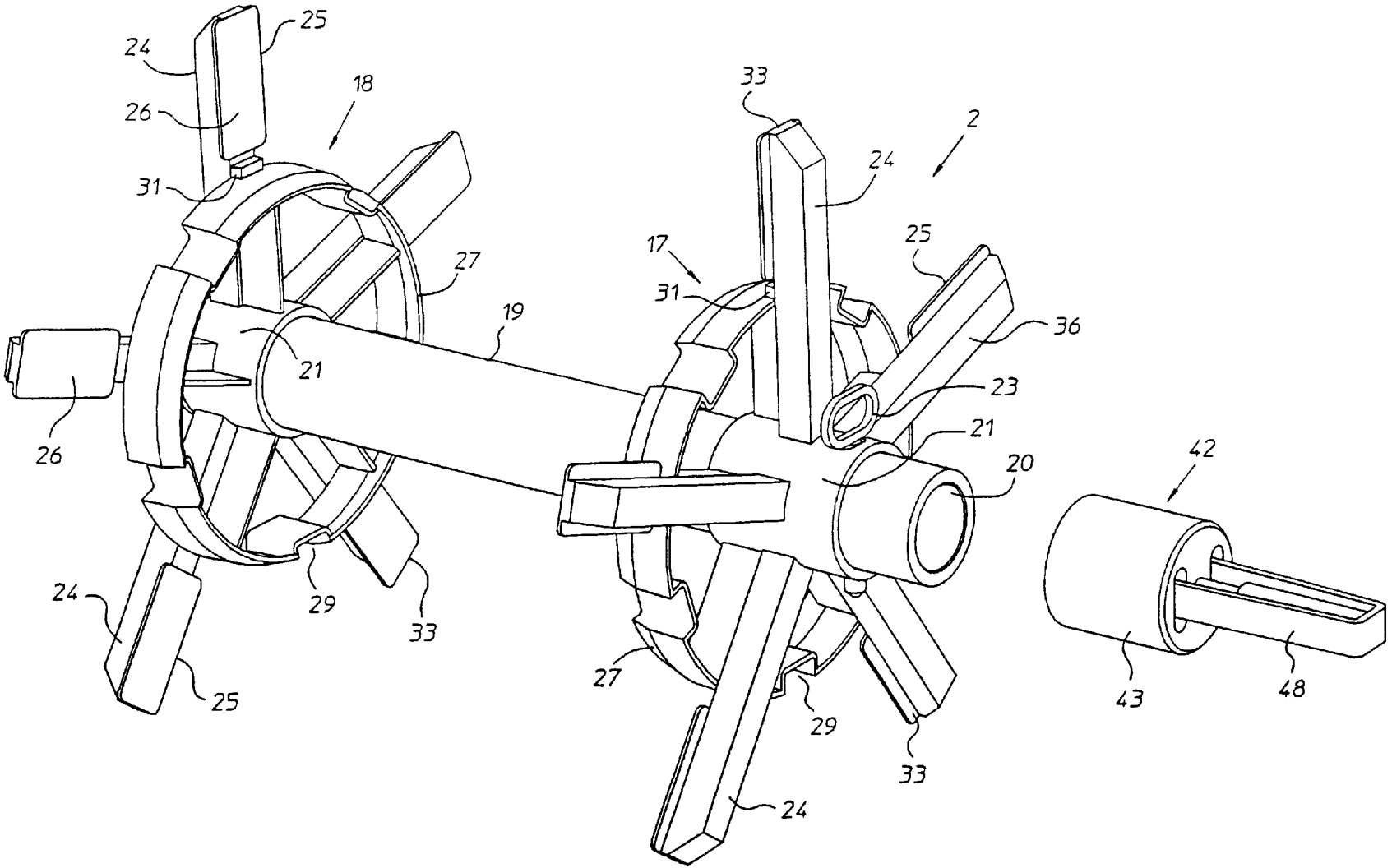
FIG. 1 shows in perspective a first tool which is particularly suitable for use when coiling a cable, etc.
Figure 3:
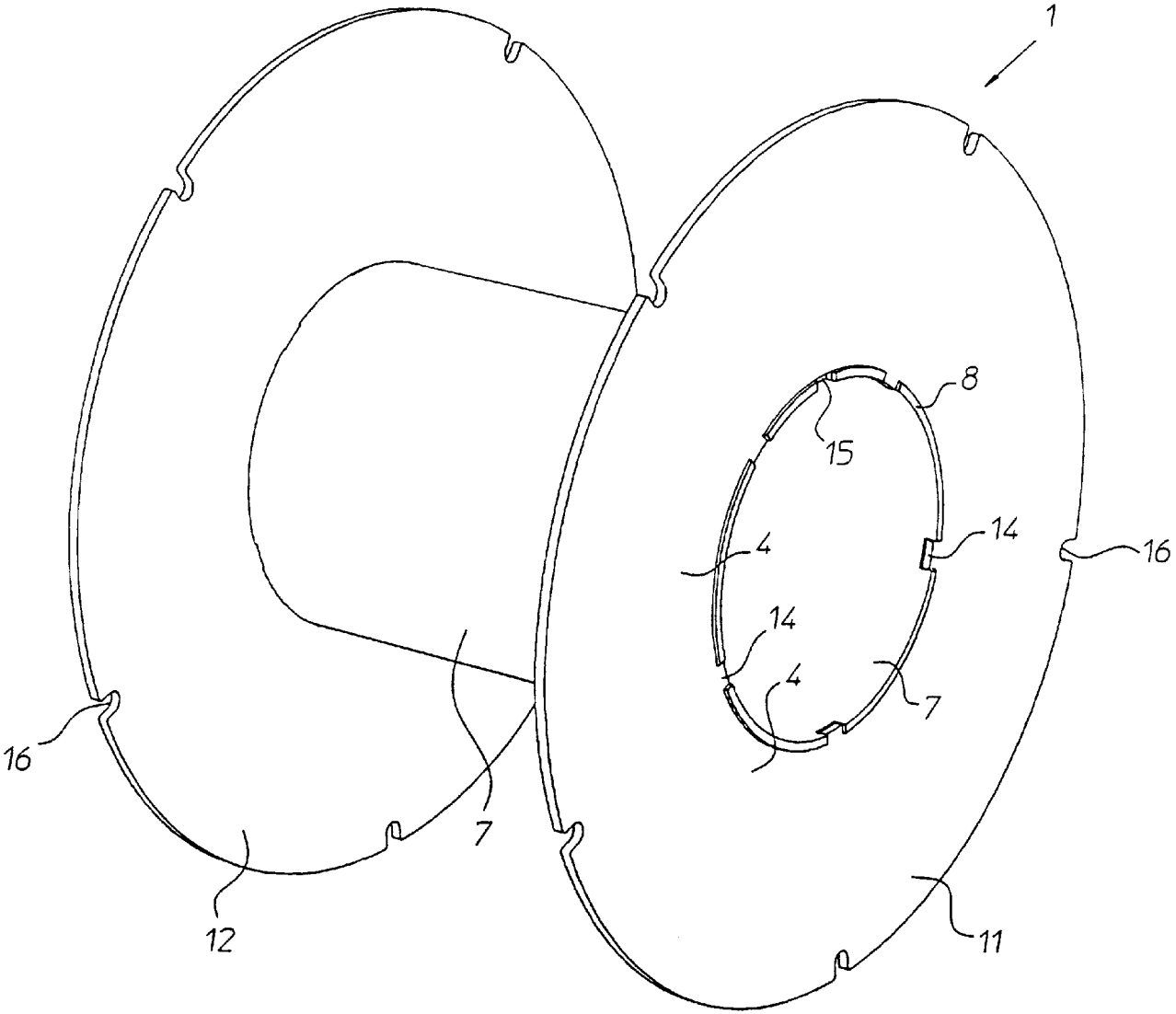
FIG. 3 shows the finished drum.
Figure 10:
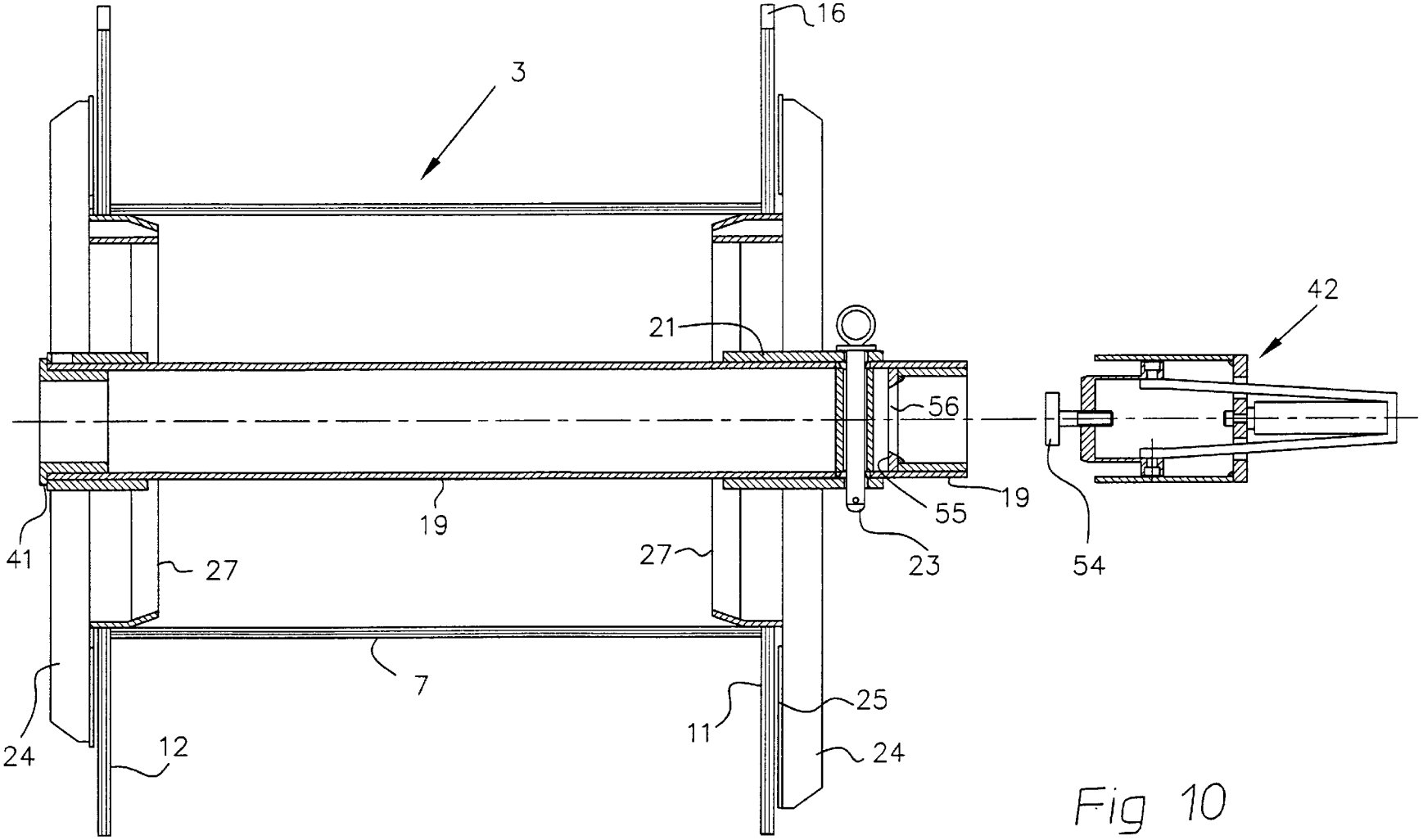

In FIG. 1 a first tool 2 is shown for detachable connection to a drum 1, shown in more detail in FIG. 3, in order to produce a rotatable unit 3, shown in more detail in FIG. 10. The drum 1 shall carry a coil 5, shown in more detail in FIG. 11, of a continuous flexible object 6 comprising cable, line, wire, wire cable, rope, cord, ribbon, hose, chain or the like.

Figure 2:
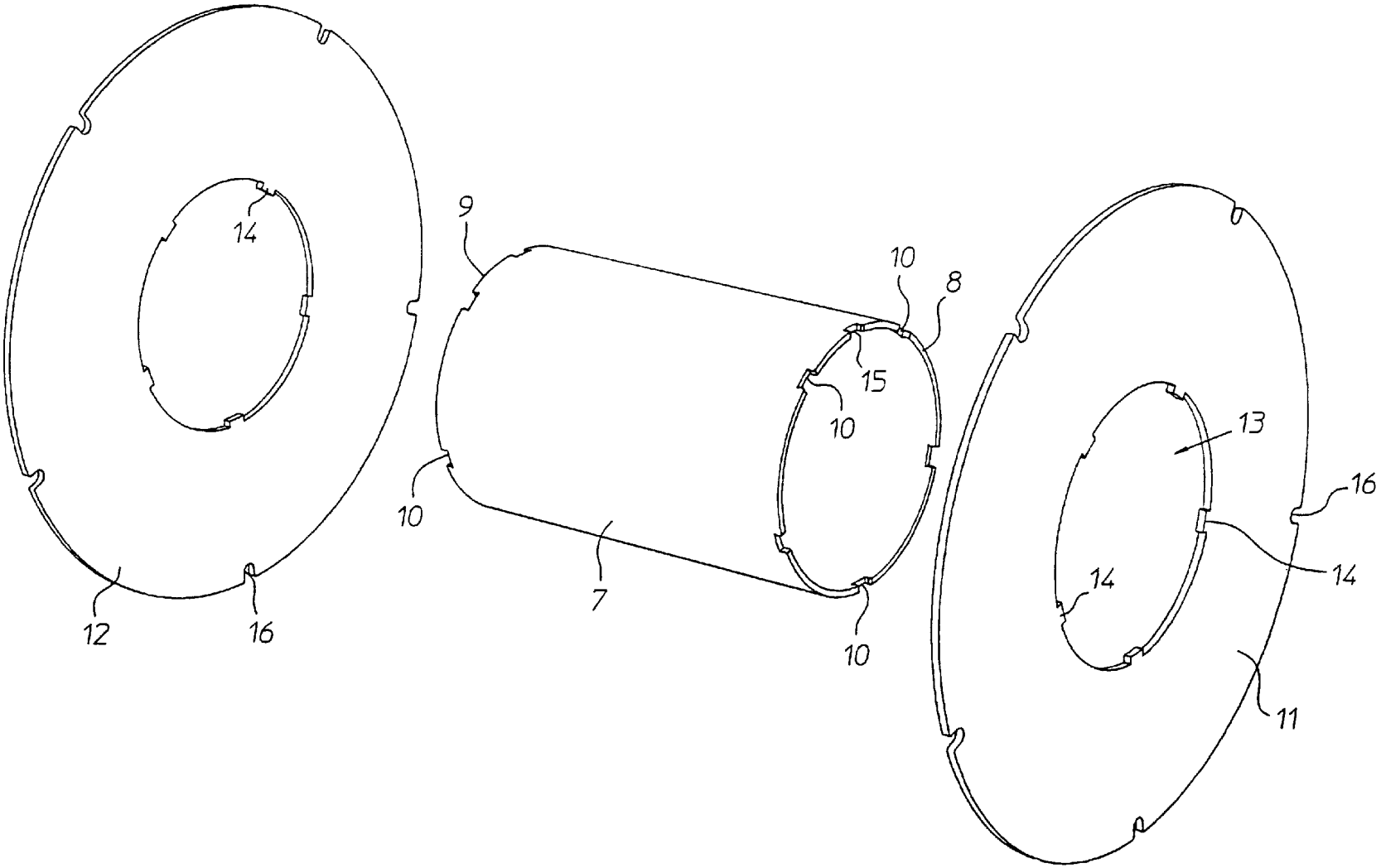
FIG. 2 shows parts of a drum to which the tool in FIG. 1 shall be connected.

The drum 1 (see FIGS. 2 and 3) comprises a cylindrical sleeve 7 with parallel end surfaces 8, 9. The drum is axially open, i.e. it has a through-going aperture, and has predetermined length and diameter. The sleeve 7 is shaped with a predetermined number of identically shaped notches 10 spaced uniformly around the periphery and extending axially inwards from the end surfaces 8, 9. In radial direction the notches 10 are through-going, i.e. they extend between the inside and the outside of the sleeve 7. The notches 10 at one end surface 8 are located axially opposite to the notches 10 at the other end surface 9. The drum 1 is also provided with two identical circular end pieces 11, 12, each having a concentric central hole 13 with a diameter equal to or slightly larger than the diameter of the sleeve 7 so that the sleeve can be inserted into the central hole 13 of the end pieces 11, 12 and received therein without clearance and so that the end pieces 11, 12 are centered to the sleeve 7. Within the area of the central hole 13 the end pieces 11, 12 are provided with a predetermined number of radially inwardly directed protrusions 14 spaced uniformly around the periphery and corresponding in shape to the notches 10 so that the protrusions 14 can be pressed into the notches 10 upon coaxial and parallel displacement of the end pieces 11, 12 towards the sleeve 7. The predetermined number of notches 10 corresponds to the number of protrusions 14 and is at least three. The depth of the notches 10 is equivalent to or somewhat larger than the thickness of the end pieces 11, 12 so that the outside of the end piece will coincide with or lie slightly inside the end surface 8, 9 when the end piece 11, 12 has been pressed to engagement with the sleeve 7 as can be seen more clearly in FIG. 3. Another notch 15, the function of which is described below, is provided at each end part of the sleeve 7. Furthermore, each end piece 11, 12 is provided with a plurality of recesses 16 around its peripheral, circular edge 37. These external recesses 16, the function of which is described below, and the protrusions 14, are radially aligned with each other. The arc sections 4 between two protrusions 14 in the end pieces have no connection with the sleeve so that such an arc section 4 can be pressed axially inwards upon application of an external force on the end piece at the centre of the arc section.

The drum 1 is of disposable type. The sleeve 7 consists of cellulosic fibre material such as rolled cardboard and compressed wood fibres, such as chips or shavings. The end pieces 11, 12 also consist of cellulosic fibre material, such as compressed wood fibres and fibreboard discs, such as plywood. An end piece of fibreboard disc has a thickness of at least 12 mm and is chosen depending on the type of object 6 to be coiled. An end piece of pressed wood fibres has a density of 700–950 kg/m$^3$ and a thickness of at least 15 mm and is chosen depending on the type of object 6 to be coiled.

Figure 4:
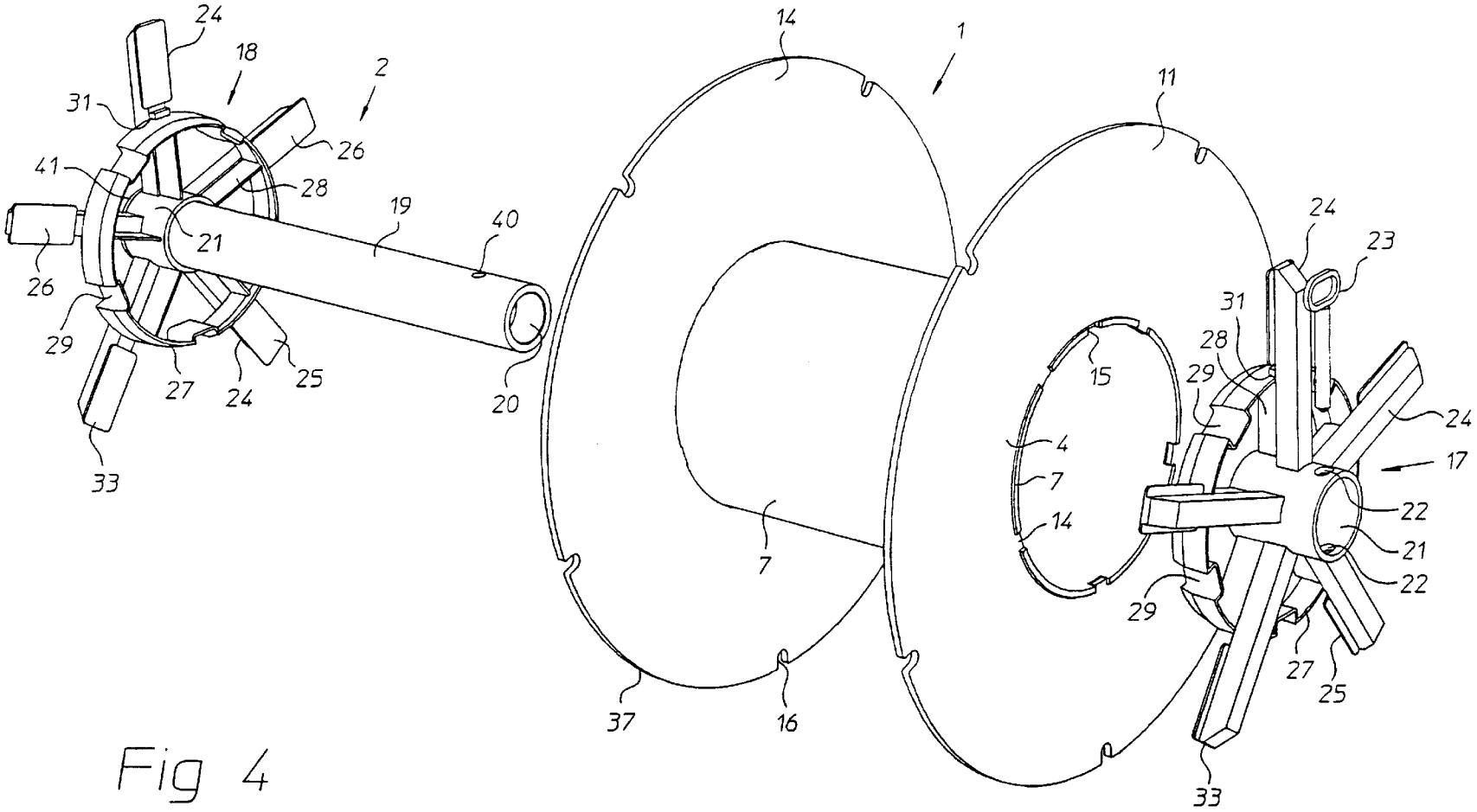
FIG. 4 illustrates assembly of the tool on the drum.
Figure 7:
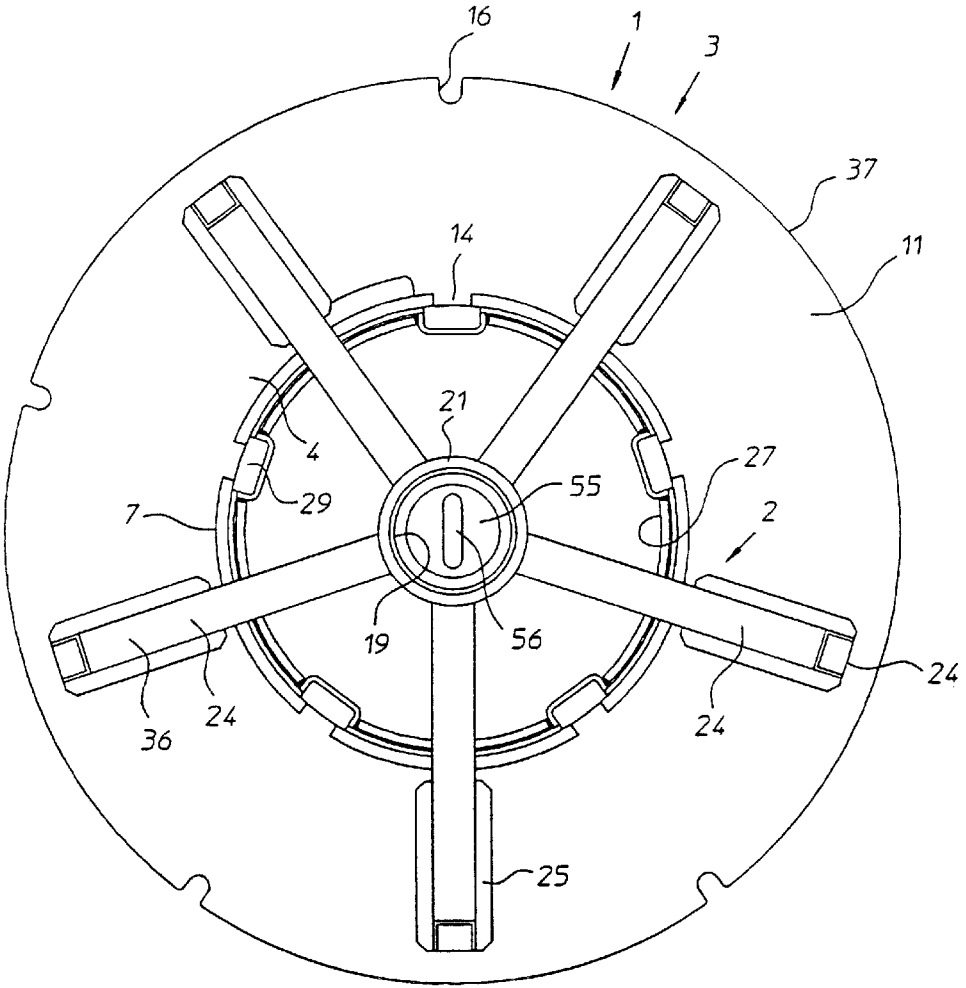
FIG. 7 is an end view of the drum and the tool before they have been locked together.
Figure 9:
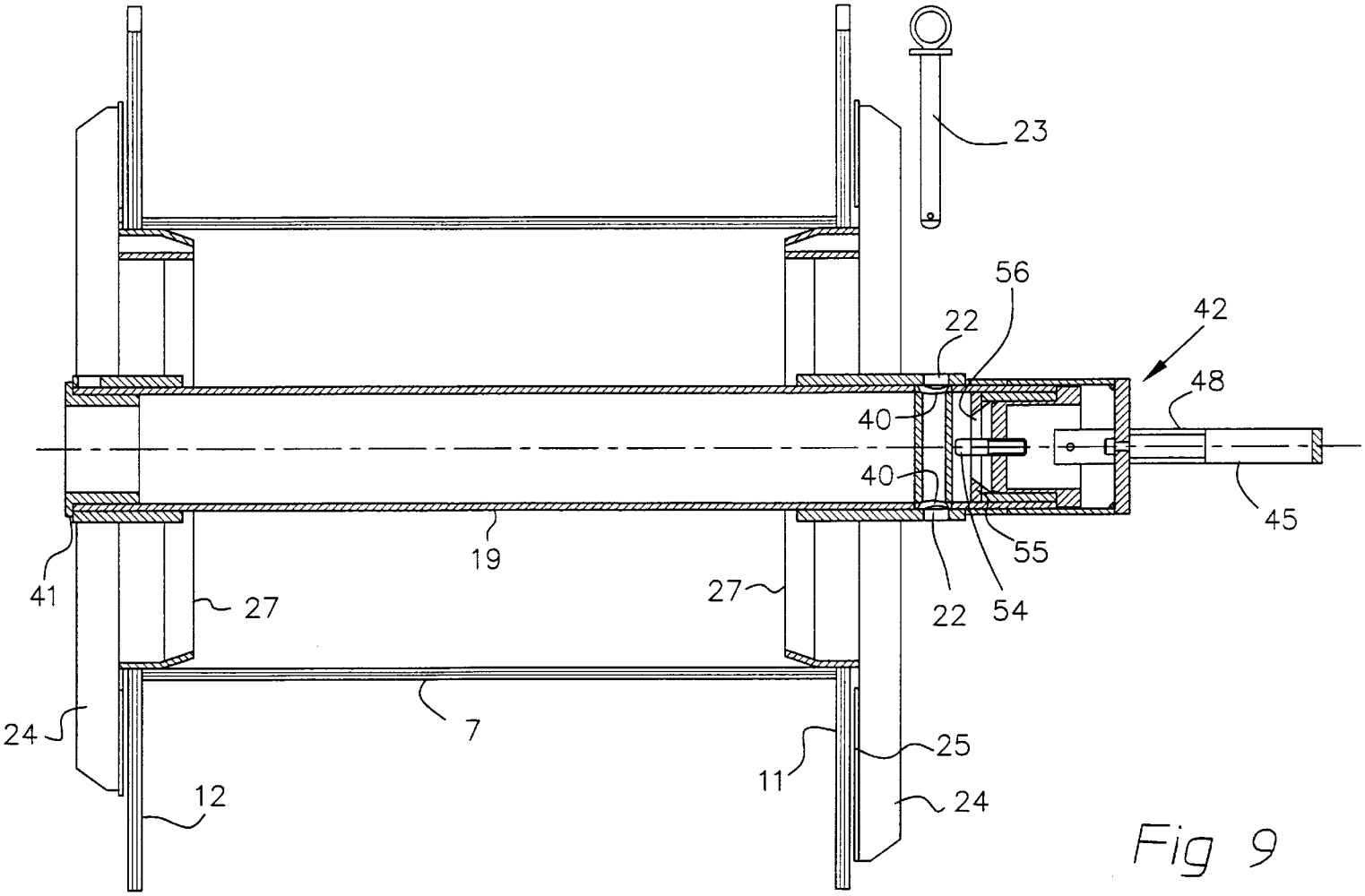
Figure 11:
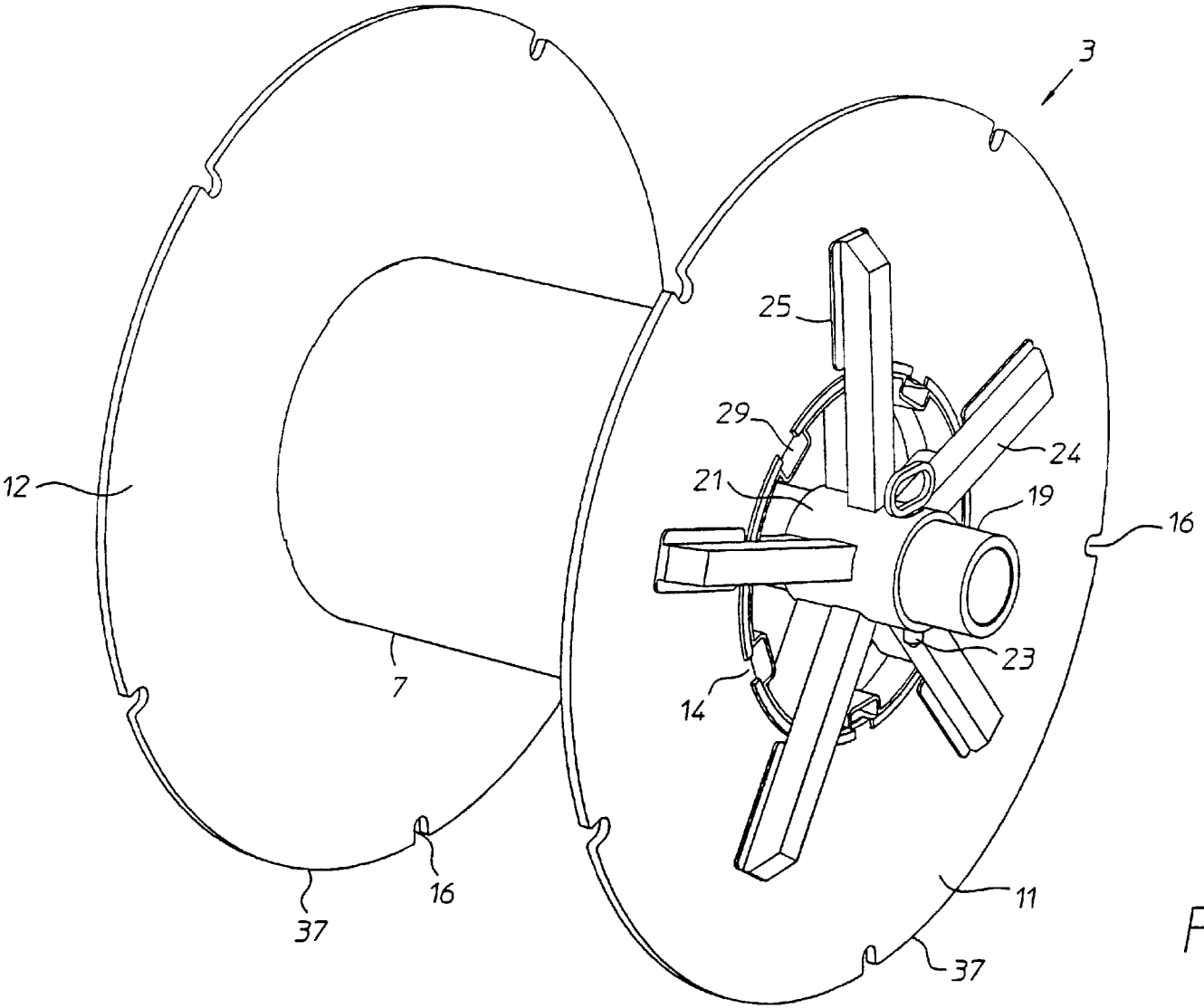
FIG. 11 is a view in perspective of the rotatable unit ready for placing in a coiling equipment.
Figure 12:
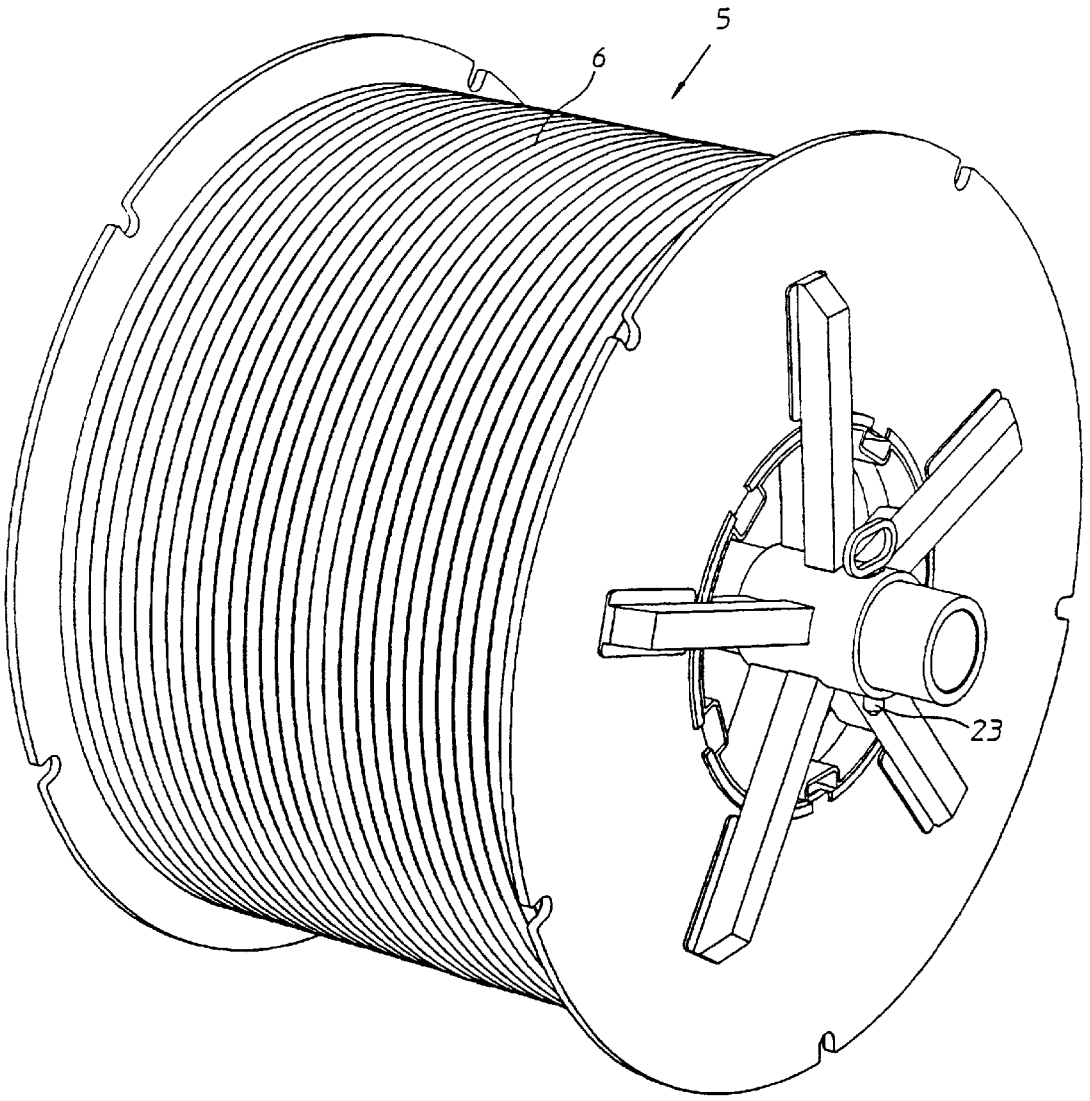
FIG. 12 shows the unit according to FIG. 11 with a finished coil of cable, etc.

The tool 2 (see FIGS. 1 and 4) comprises two support and bearing elements 17, 18 and a connecting member therefor. The connecting member comprises a cylindrical shaft 19 with through-hole 20, and an anchoring means. The shaft 19 is designed to carry the two support and bearing elements 17, 18. Each support and bearing element 17, 18 includes a hub-forming cylindrical sleeve 21 designed to receive the shaft 19 without clearance. At least one, 17, of the support and bearing elements is provided at its outer end portion with two diametrically situated holes 22 to receive a locking device, e.g. a locking pin 23. The shaft 19 is provided with two corresponding holes 40 to receive said locking pin 23 when said holes 22 and 40 are aligned with each other. Each support and bearing element 17, 18 has a plurality of support arms 24 which are permanently joined to the hub 21 to form a rigid unit and extend radially from the hub 21, their free ends 33 being situated in a common circle with a radius less than the radius of the end pieces 11, 12, as can be seen in FIG. 7. The support arms 24 form right angle to the central axis of the hub 21, but they may alternatively be inclined somewhat inwardly. At their free end portions 36 the support arms 24 are provided with flat support plates 25 having flat support surfaces 26, located in one and the same plane, which form right angles to the shaft 19. Each support and bearing element 17, 18 is provided with an endless support ring 27, concentric with and permanently joined to the support arms 24. The support ring 27 is located on the inner side of the support and bearing element 17, 18 and has predetermined axial dimension. A plurality of spokes 28, corresponding to the number of support arms 24, are arranged between the hub 21 and the ring 27, permanently connected therewith and with the support arms 24, in order to reinforce the support ring 27. The spokes 28 take up a considerable share of the load acting on the sleeve 7 during coiling. The support ring 27 is designed for insertion into the sleeve 7 of the drum in order to support and center the drum 1. To facilitate insertion the leading portion of the support ring 27 is suitably conical, continuing into a cylindrical portion, as shown. Alternatively the entire support ring 27 may be conical. In both cases the largest diameter of the support ring 27 corresponds to the inner diameter of the sleeve ±2 mm. The axial dimension of the support ring 27 is chosen so that sufficient engagement is obtained with the sleeve 7 to absorb the load from the coil 5 of cable 6, etc., without being damaged or deformed. The support ring 27 has a predetermined number of uniformly distributed notches or recesses 29, open in axial direction and having a depth, i.e. radial extension, sufficient to allow securing bands 30 (see FIG. 13) to be quickly and simply threaded through the notches 29 forming axial apertures. The notches 29 are situated between the support arms 24 equidistant from two adjacent support arms 24. The number of notches 29 thus corresponds to the number of support arms 24. A follower boss 31 is rigidly arranged on the inside of one of the support arms 24, immediately outside the support ring 27, i.e. in contact with its outer side and at a distance from the central axis of the tool 2 equal to the radius of the sleeve 7. This follower boss 31 is arranged to be brought into engagement with said additional axial notch 15 located in the end portion of the sleeve 7 midway between two of the notches 10 designed to receive the protrusions 14 of the end piece. The follower boss 31 secures the drum 1 and tool 2 together circumferentially in order to absorb the torque arising when cable, etc. is wound onto or off the drum. Both the support and bearing elements 17, 18 are provided with such a follower boss 31. The follower bosses 31 also help to align the support and bearing elements 17, 18 circumferentially in relation to the drum 1 so that the notches 29 in the support rings 27 will automatically be positioned opposite and radially inside the protrusions 14 on the end pieces 11, 12 when the follower bosses 31 are axially aligned with the additional notches 15. The number of support arms 24 is at least three, from which it follows that the number of notches 29 is also at least three and equal to the number of support arms 24. The support plates 25 of the support arms 24 are situated within the area of the end pieces 11, 12 to prevent contact with the end surfaces 8, 9 of the sleeve 7, as can be seen in FIGS. 9 and 11. A stop flange 41 serving as counter-support for the support and bearing element 18 is arranged at the end portion of the shaft 19 facing away from the other end portion provided with holes 40. Said stop flange 41, holes 22 and 40 and locking pin 23 together form an anchoring means for anchoring the support and bearing elements 17, 18 to the shaft 19 and at the same time securing the sleeve 7 against axial displacement in relation to the shaft. The support and bearing elements 17, 18 are situated a predetermined distance d from each other when thus anchored. When the tool is used in a rotatable unit for coiling, the sleeve has no contact with the support and bearing elements 17, 18 and the sleeve is thus secured against axial displacement by means of the end pieces 11, 12, more specifically by the protrusions 14 on the end pieces.

Figure 5:
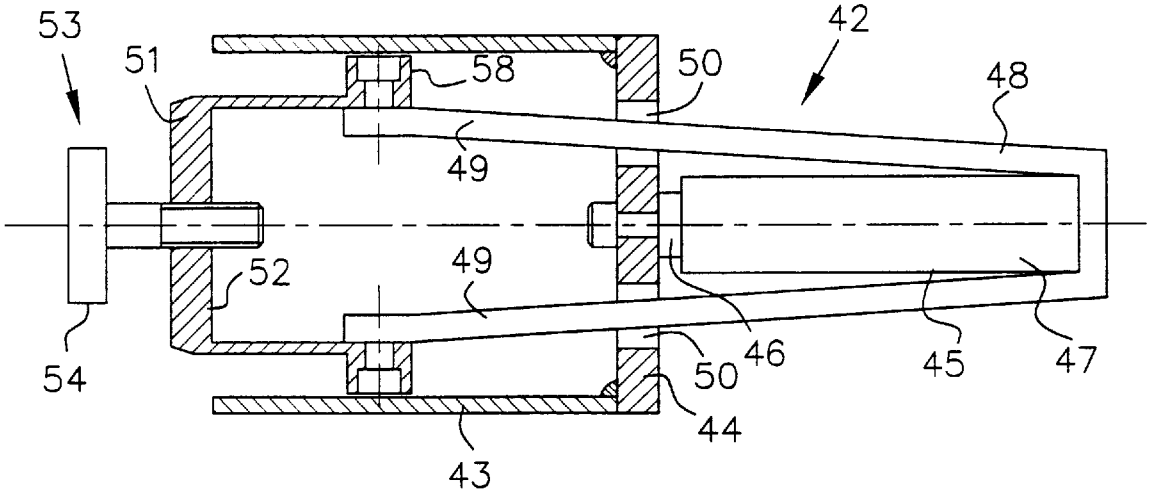
FIGS. 5 and 6 show a longitudinal section through a tensioning device for the tool according to FIG. 1, in inactive and active position, respectively.
Figure 6:
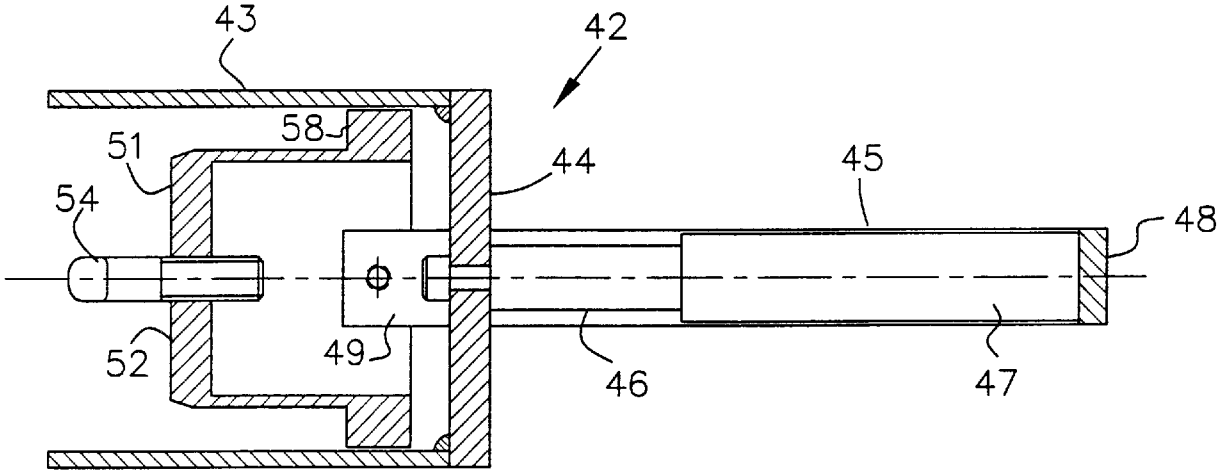
Figure 8:
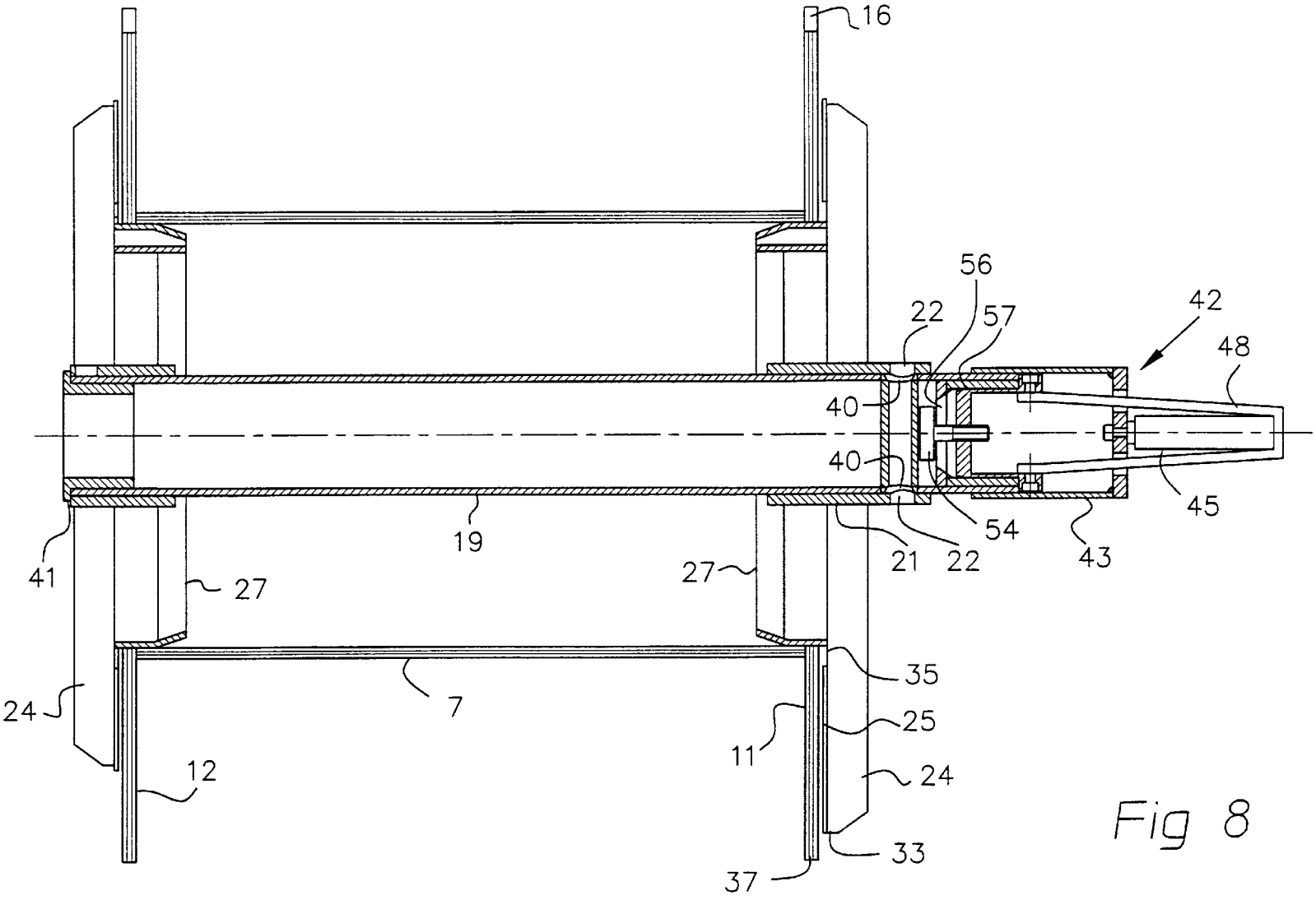
FIGS. 8, 9 and 10 show different steps in the assembly process with the aid of the tensioning device shown in FIG. 5.

The tool also includes a tensioning device 42 which is intended to be brought into engagement with the end portion of the shaft 19 provided with said holes 40 for the locking pin 23. As can be seen more clearly in FIGS. 5 and 6, the tensioning device has a cylindrical pressure sleeve 43 which has an inner diameter somewhat larger than the outer diameter of the shaft 19. The pressure sleeve 43 is closed at one end by a wall 44 which offers counter-support to a pressure device 45 in the form of a pneumatic or hydraulic cylinder with its plunger 46 attached in the wall 44 and cylinder 47 in a yoke 48, the shanks 49 of which extend through openings 50 in the wall 44. A cup-shaped tractive body 51 is slidably arranged in the pressure sleeve 43 and is firmly screwed to the shanks 49 of the yoke. The bottom wall 52 of the tractive body 51, in sliding contact with the inner side of the pressure sleeve 43, is provided with a coaxial, T-shaped locking mechanism 53 with a free radial locking peg 54. At the end (see FIG. 8) of the shaft 19 provided with the holes 40 for the locking pin 23 is a fixed counter-support wall 55 with a rectangular, vertical aperture 56 which is somewhat larger than the locking peg 54, allowing the latter to be passed through the aperture 56 when they are aligned with each other with regard to their geometric shapes. 57 denotes a support sleeve joined to the counter-support wall 55, in which support sleeve the tractive body 51 of the tensioning device 42 is received when the tensioning device 42 is moved coaxially in towards the shaft 19. When fully inserted, the rear guiding flange 58 of the tractive body 51 is in contact with the end surfaces of the shaft 19 and support sleeve 57, and the locking peg 54 is located outside the counter-support wall 55. By turning the locking peg 54 90° with the aid of the yoke 48, the locking peg 54 is brought into locking engagement with the counter-support wall 55. Upon activation of the pressure device 45, the plunger 46 presses the pressure sleeve 43 in over the end portion of the shaft until it is brought into contact with the hub 21. Upon continued activation, the hub 21 is then moved inwards so that its holes 22 are aligned coaxially with the holes 40 of the shaft 19, after which the locking pin 23 can be passed through the holes 22 and 40 to locking position. After returning the pressure sleeve 43 to its original position and deactivating the pressure device 45, the tensioning device is removed and the rotatable unit 3 is ready to be placed in a coiling machine. When the coil 5 has been produced and the tool 2 is to be removed from the finished coil parcel 32, the tensioning device 42 is again connected to the shaft 19 to enable removal of the locking pin 23 which is clamped with a considerable force derived from the coil 5 and transmitted via the end pieces 11, 12 and support and bearing elements 17, 18 to the shaft 19 via the locking pin 23. When the tensioning device 42 is activated the pressure sleeve 43 presses against the hub 21 with sufficient force to overcome the force exerted on the support and bearing elements by the coil 5, so that the holes 22 and 40 of the hub 21 and shaft 19 are aligned axially with each other, after which the locking pin 23 can be lifted up. In the starting position shown in FIG. 8, when the tensioning device 42 is inoperative and the support plates 25 are in contact with the end pieces 11, 12 without the influence of any external force, the distance between the support elements 17 and 18, measured between the support plates, is $d+\geqq 1$ mm, e.g. d+3 mm. In the setting position as shown in FIG. 9, when the tensioning device 42 is operative and the support plates 25 have pressed in free arc sections 4 of the end pieces so that the holes 22 and 40 are coaxial with each other, the distance between the support elements 17 and 18 is d−x mm, e.g. d−2 mm, where x is equal to the gap (tolerance) between the locking pin 23 and the walls of the holes 22 and 40. In the final position, shown in FIG. 10, when the locking pin 23 is in locked position and the tensioning device 42 has been removed from the shaft 19, the distance between the support and bearing elements 17 and 18 is d mm. In this final position, therefore, there is a favourably pretension in the end pieces 11, 12. From FIG. 8 it is clear that a gap 35 also exists between one end surface of the sleeve and the support arms 24, thus allowing said displacement of the tensioning device 42.

Figure 13:
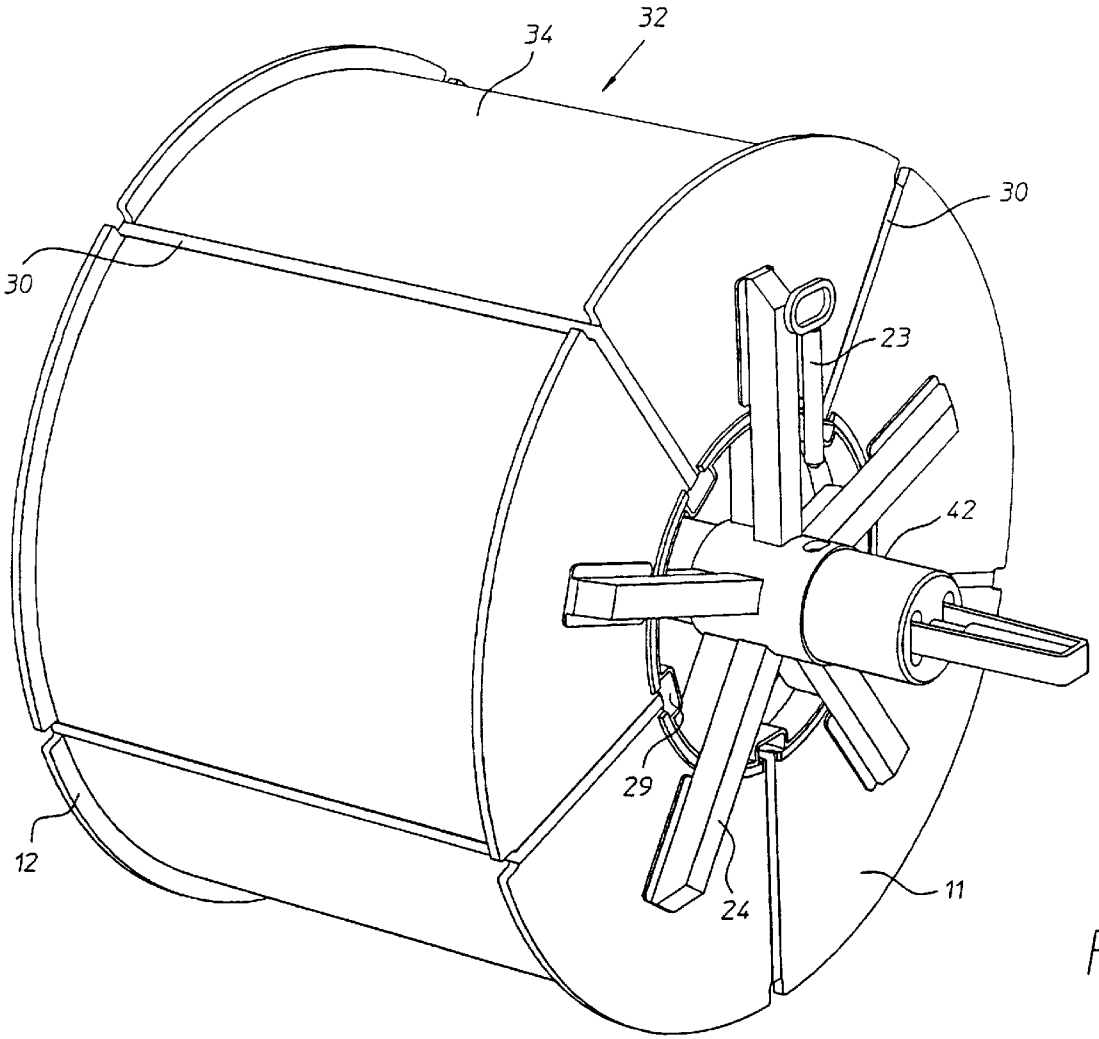
FIG. 13 shows the unit with coil according to FIG. 12, provided with protective casing and securing bands to form a parcel, and the tensioning device connected to the unit ready for dismantling.
Figure 14:
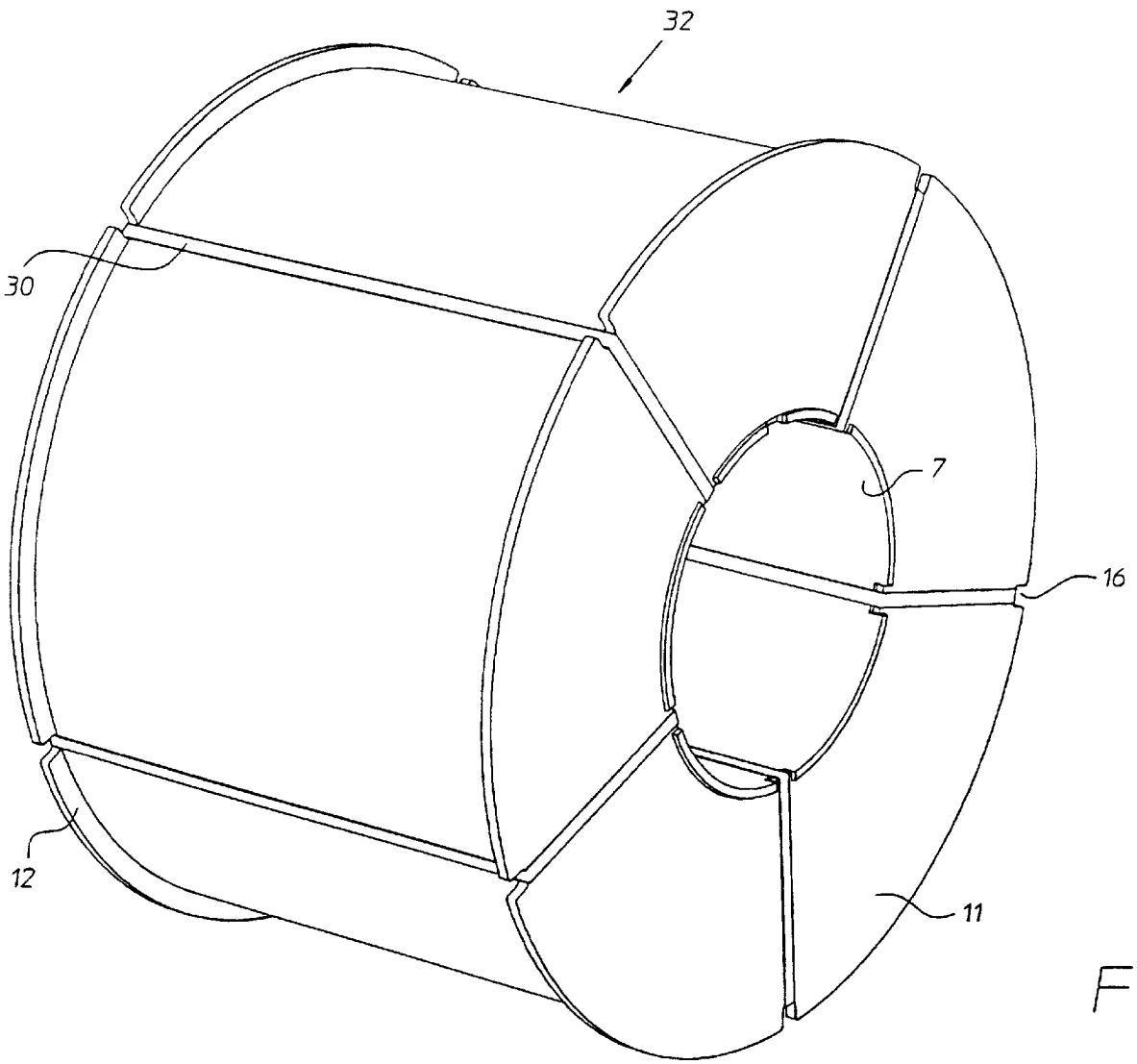
FIG. 14 shows the finished wrapped parcel of coil when the tool has been dismantled.

FIGS. 2–14 illustrate various steps in the production of a parcel 32 of a coil 5 ready for storage or delivery to a customer. The initial step is assembly of the drum 1 from the three parts 7, 11, 12, after which the tool 2 is fitted on the drum to produce a rotatable unit 3 as shown in FIG. 7. The rotatable unit 3 is placed in a stationary coiling machine (not shown) in an industry for supplying cable, etc., the coiling machine being provided with spindles for receipt in the holes 20 of the shaft 19 in order to drive the shaft. A cable 6, etc., is wound onto the rotating unit 3 so that a coil 5 is formed of predetermined diameter, said diameter being less than that of the end pieces 11, 12. The unit 3 with the finished coil 5 is then conveyed to a wrapping station where the coil 5 is first surrounded by a protective casing 34, preferably of cardboard, after which securing bands 30 are threaded through the notches 29 and sleeve 7 and clamped around the sleeve 7, end pieces 11, 12 and coil 5. The securing bands 30 extend through the peripheral notches on the end pieces 11, 12 and over the protrusions 14 of the end pieces so that most of the clamping force from the securing bands 30 will be exerted on these points instead of on the sleeve 7. The parcel 32 thus becomes more stable. In the next step the tool 2 is dismantled from the drum 1 as illustrated in FIG. 13 to release the finished parcel 32 as shown in FIG. 14.

Figure 15:
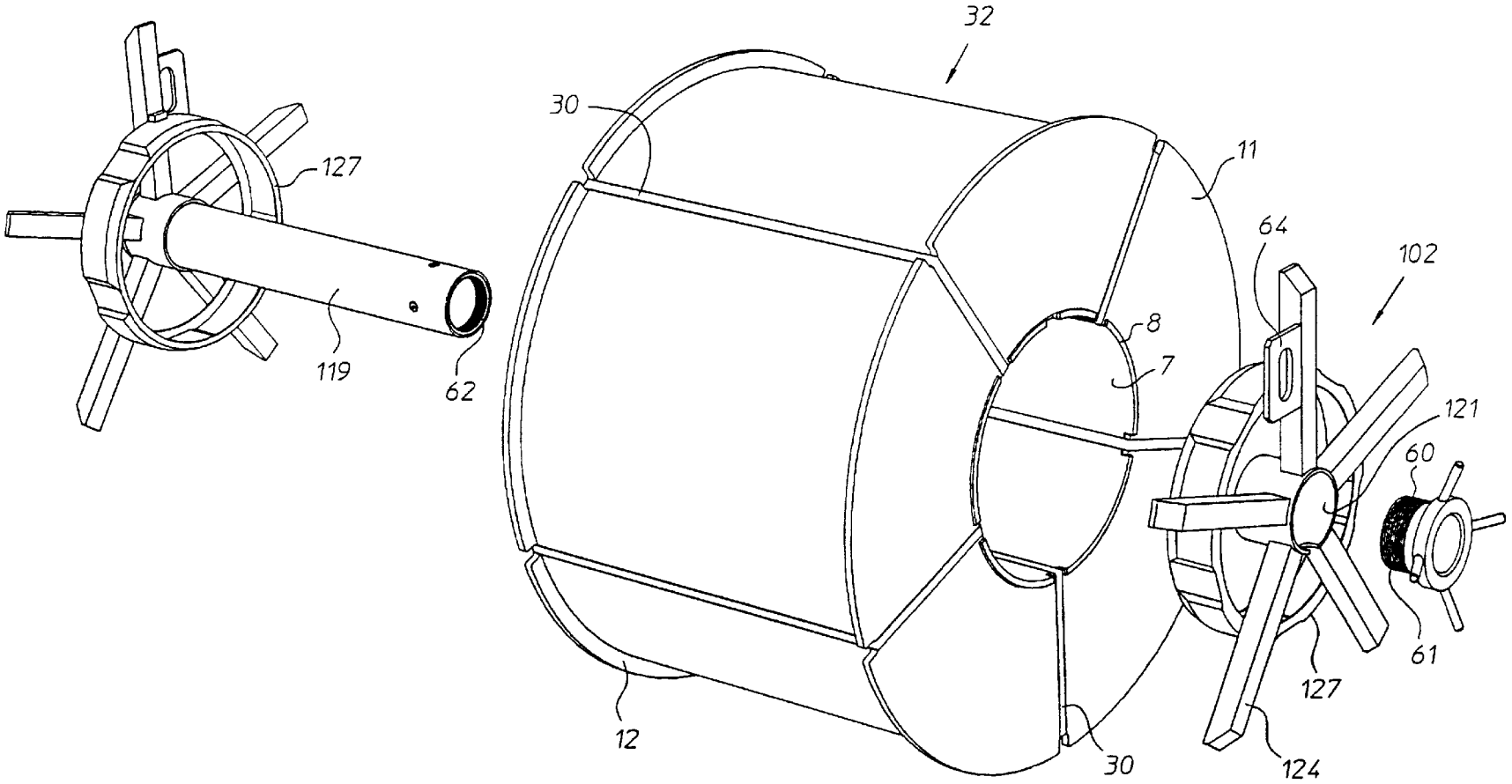
FIG. 15 is a view in perspective of the finished coil parcel according to FIG. 14 and a second tool to be fitted onto the coil parcel to form a second rotatable unit for use in the field.

For unwinding the cable 6, etc. on site a second tool 102, shown in FIG. 15, is used which has the same basic structure as the industrial tool shown in FIG. 1 but is somewhat simplified since the strain on the tool is not as great during unwinding as during winding of the cable 6, etc. The same reference designations are used for equivalent constructional elements as in the industrial tool, but with the addition of "100".

The support ring 127 has no inner connection with the hub 121, similar to the spokes 28 in the industrial tool 2. It is rigidly joined to the radial support arms 124 at one side so that the hub 121, support arms 124 and support ring 127 form a rigid unit. Furthermore, the support arms 124 need not initially be pressed against the end pieces 11, 12 by some externally applied force, but may abut both the end pieces 11, 12 and the end surfaces 8, 9 of the sleeve 7. In this case the anchoring means of the connection member includes a locking sleeve 60 with external threading 61, which is brought into engagement with internal threading 62 in the shaft 119, the other end of which has a stop flange 141. The locking sleeve 60 is provided with a handle 64 to facilitate turning the locking sleeve 60 into and out of its thread engagement with the shaft 119.

Figure 16:
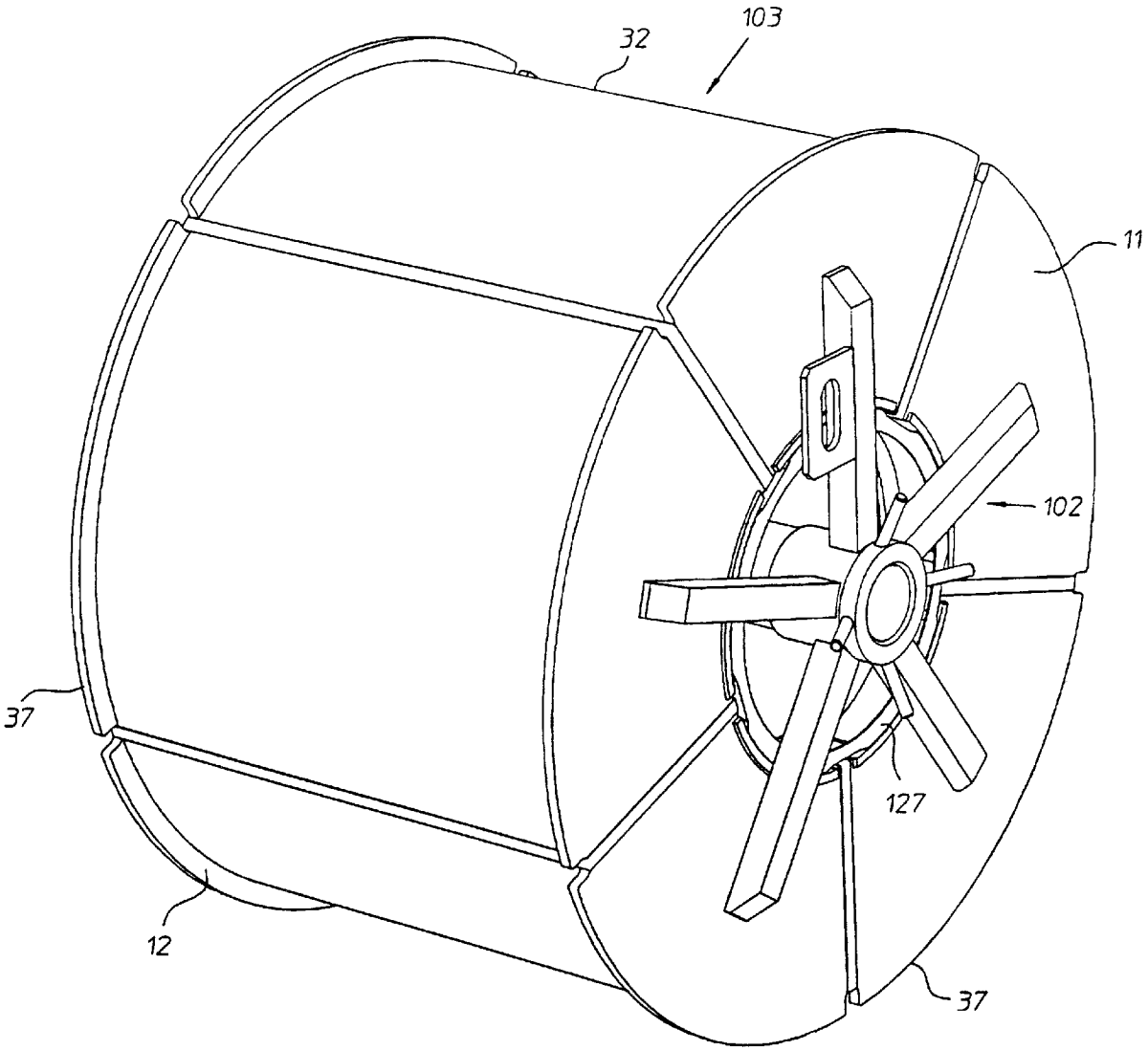
FIG. 16 shows the rotatable unit ready to be placed in an uncoiling equipment.
Figure 17:
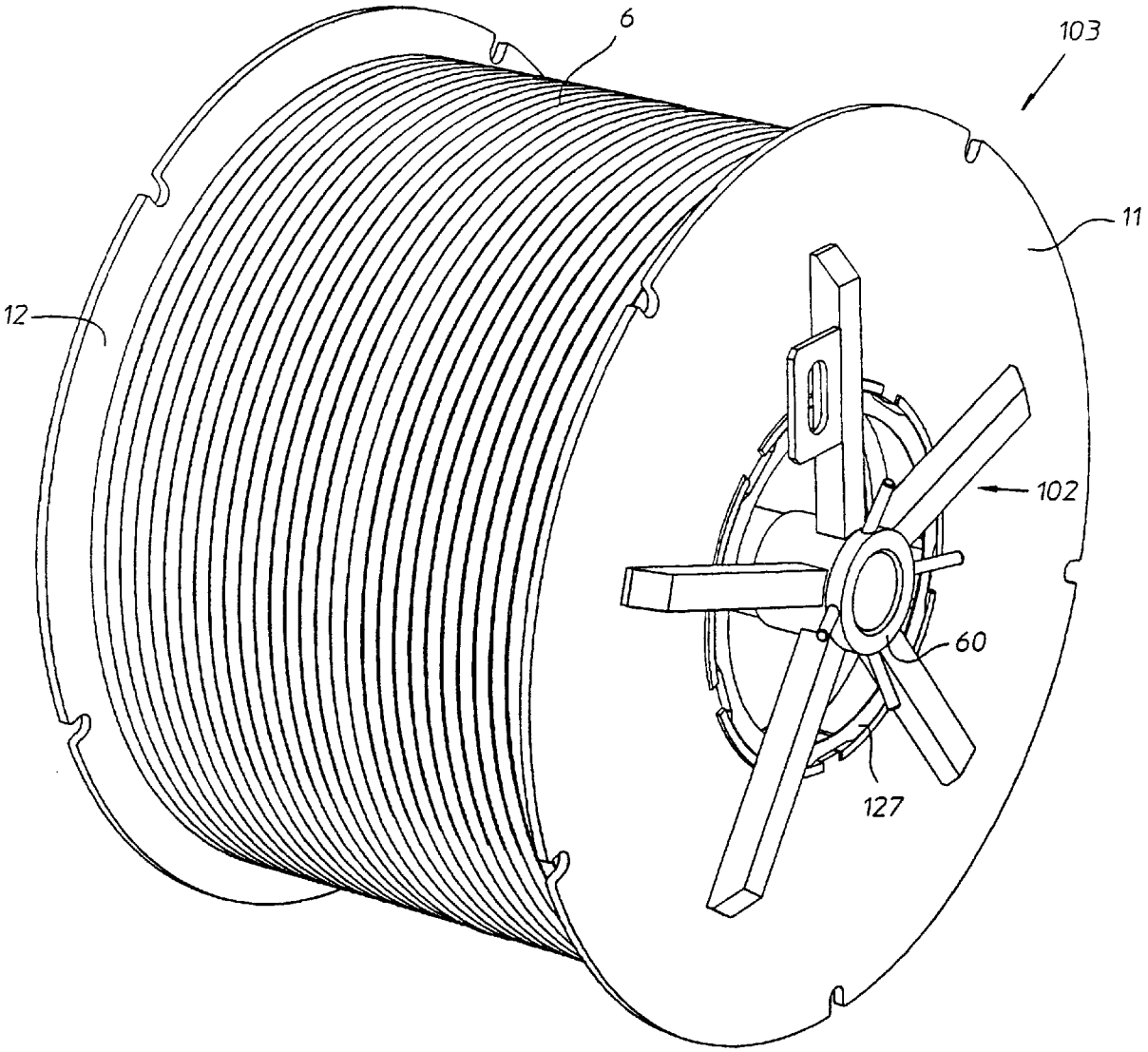
FIG. 17 shows the rotatable unit from which the protective casing and securing bands have been removed.
Figure 18:
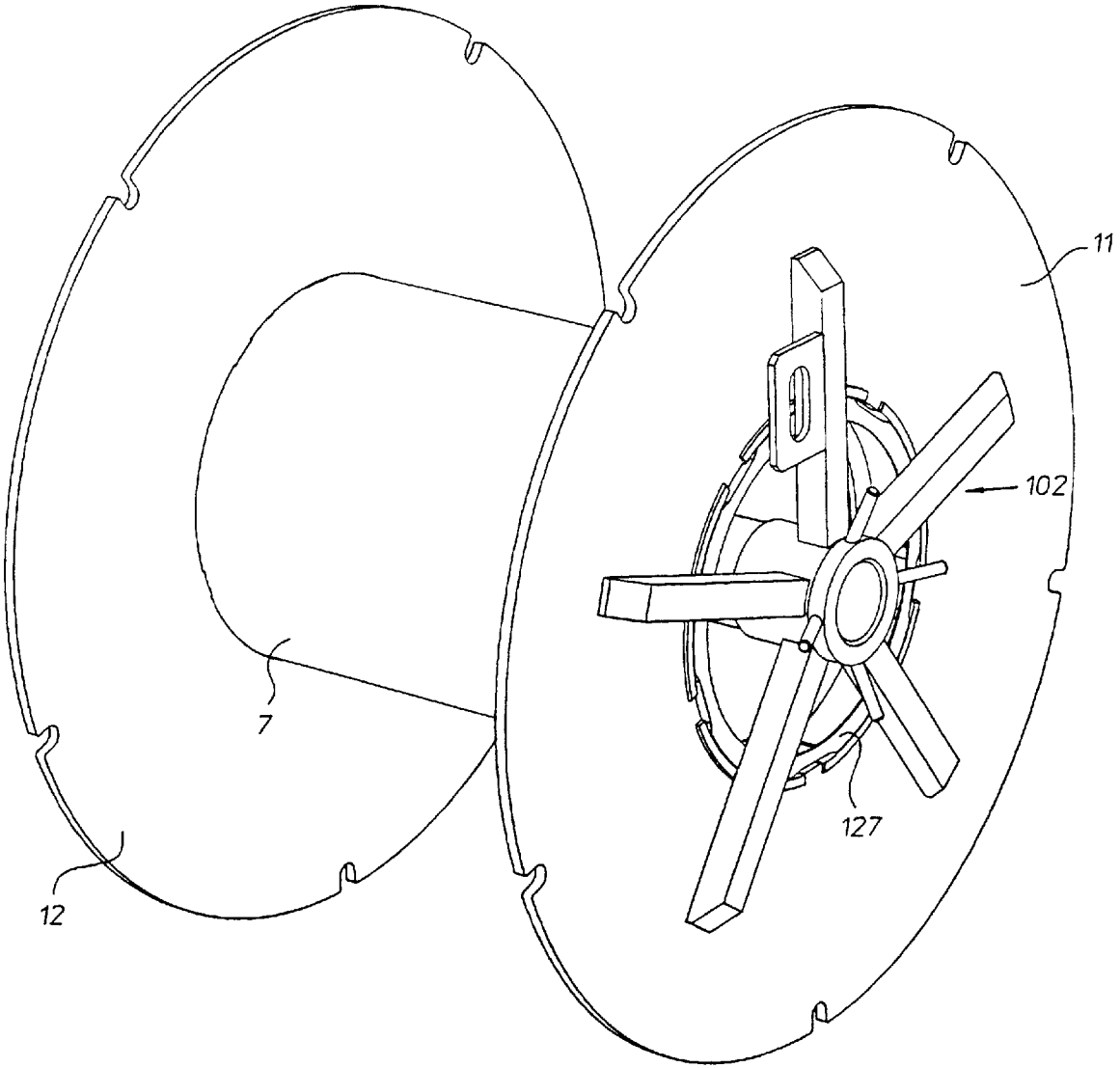
FIG. 18 shows the rotatable unit after the cable, etc. has been entirely unwound.

FIGS. 16–18 illustrate various steps for producing a second rotatable unit 103 on site, out of the coil parcel 32 supplied and the second tool 102. When the finished unit 103 is placed in an unwinding machine (not shown), the securing bands 30 are cut and removed, together with the protective casing 34 to prepare the cable, etc. for unwinding as illustrated in FIG. 17. After unwinding, the tool is dismantled for reuse, while the end pieces are removed from the sleeve and discarded.

I claim:

1. A tool for detachable assembly on a drum of disposable type to form a rotatable unit to be placed in journalling equipment for rotation of the unit, said drum comprising a cylindrical sleeve and two end pieces which are secured to the sleeve to prevent them from slipping axially towards each other, the drum being designed to carry a coil of a continuous flexible object comprising cable, line, wire, wire cable, rope, cord, ribbon, chain or the like, said tool comprising two support and bearing elements, each having a hub-forming sleeve, a plurality of support arms rigidly joined to the hub and forming right angle or substantially right angle with the central axis of the hub, and a concentric support member for supporting and centering the drum by internal engagement with both end portions of the sleeve; and also a connecting member comprising a shaft arranged to extend through the sleeve and said hubs, and anchoring means for anchoring the support and bearing elements to said shaft while at the same time securing the sleeve against axial displacement in relation to the shaft, said support arms positioned to abut in a supporting manner against the end pieces and have free ends located radially inside the outer circular edge of the end pieces so that the support arms are not in contact with the ground when said unit is resting on the ground by the end pieces of the drum.

2. A tool as claimed in claim 1, characterized in that the support arms are spaced from the end surfaces of the sleeve in order to form a gap therebetween, and that it also comprises a tensioning device arranged to be brought into engagement with the shaft to press the support and bearing elements towards each other and bring them into position for anchoring to said shaft by means of said anchoring means during said assembly and to bring them out of said position for their release from the shaft when dismantling the unit provided with coil.

3. A tool as claimed in claim 2, characterized in that said anchoring means comprise a stop flange at one end portion of the shaft to serve as a counter-support for one of the support and bearing elements, radial holes in the other end portion of the shaft, radial holes in the hub of the other support and bearing element and a locking device arranged to be brought into engagement with said radially directed holes of the hub and shaft which are aligned with each other, after said position has been set by means of said tensioning device.

4. A tool as claimed in claim 2, characterized in that the end portions of the support arms are provided with flat support plates arranged to press against the end pieces in order to pre-tension them during said assembly.

5. A tool as claimed in claim 1, characterized in that the supporting member consists of a endless support ring provided with a predetermined number of radial notches forming axial apertures which are located equidistant from the support arms for the passage of securing bands surrounding the coil.

6. A tool as claimed in claim 1, characterized in that the end portions of the sleeve are provided with a predetermined number of uniformly distributed, axial notches through-going in radial direction, and that each end piece is provided with a corresponding number of radially inwardly directed protrusions arranged to be brought into engagement with the axial notches in the sleeve in the event of coaxial and parallel displacement of the end pieces towards each other and towards the end portions of the sleeve.

7. A tool as claimed in claim 6, characterized in that the notches of the support rings are arranged to be radially aligned with the protrusions of the end pieces so that said securing bands are brought into contact with the protrusions upon surrounding the coil.

8. A tool as claimed in claim 6, characterized in that each end portion of the sleeve is provided with at least one additional notch and that each support and bearing element is provided with a corresponding follower boss arranged on the inside of one of the support arms to be brought into engagement with said additional notch to form a detachable joint so that the drum is prevented from turning in relation to the support and bearing elements.

9. A tool as claimed in claim 8, characterized in that the end pieces consist of laminated plates of fibreboard having a thickness of at least 12 mm.

10. A tool as recited in claim 8 wherein the end pieces comprise pressed fiberboard plates having a thickness of at least 15 mm and a density of 700–950 kg/m$^3$.

11. A combination of drum of disposable type and tool for detachable assembly on a drum to form a rotatable unit to be placed in journalling equipment for rotation of the unit, said drum comprising a cylindrical sleeve and two end pieces which are secured to the sleeve to prevent them from slipping axially towards each other, the drum being designed to carry a coil of a continuous flexible object, comprising cable, line, wire, wire cable, rope, cord, ribbon, chain or the like, said tool comprising two support and bearing elements, each having a hub-forming sleeve, a plurality of support arms rigidly joined to the hub, and forming right angle or substantially right angle with the central axis of the hub, and a concentric support member for supporting and centering the drum of internal engagement with both end portions of the sleeve; and also a connecting member comprising a shaft arranged to extend through the sleeve and said hubs, and anchoring means for anchoring the support and bearing elements to said shaft while at the same time securing the sleeve against axial displacement in relation to the shaft, said support arms positioned to abut in a supporting manner against the end pieces and have free ends located radially inside the outer circular edge of the end pieces so that the support arms are not in contact with the ground when said unit is resting on the ground of the end pieces of the drum.

12. A combination as claimed in claim 11, characterized in that the support arms are spaced from the end surfaces of the sleeve in order to form a gap therebetween, that it also comprises a tensioning device arranged to be brought into engagement with the shaft to press the support and bearing elements towards each other and bring them into position for anchoring to said shaft by means of said anchoring means during said assembly and to bring them out of said position for their release from the shaft when dismantling the unit provided with coil.

13. A combination as claimed in claim 12, characterized in that said anchoring means comprise a stop flange at one end portion of the shaft to serve as a counter-support for one of the support and bearing elements, radial holes in the other end portion of the shaft, radial holes in the hub of the other support and bearing element and a locking device arranged to be brought into engagement with said radially directed holes of the hub and shaft which are aligned with each other, after said position has been set by means of said tensioning device.

14. A combination as claimed in claim 12, characterized in that the end portions of the support arms are provided with flat support plates arranged to press against the end pieces in order to pre-tension them during said assembly.

15. A combination as claimed in claim 11, characterized in that the supporting member consists of a endless support ring provided with a predetermined number of radial notches forming axial apertures which are located equidistant from the support arms for the passage of securing bands surrounding the coil.

16. A combination as claimed in claim 11, characterized in that the end portion of the sleeve are provided with a predetermined number of uniformly distributed, axial notches through-going in radial direction, and that each end piece is provided with a corresponding number of radially inwardly directed protrusions arranged to be brought into engagement with the axial notches in the sleeve in the event of coaxial and parallel displacement of the end pieces towards each other and towards the end portions of the sleeve.

17. A combination as claimed in claim 16, characterized in that the notches of the support rings are arranged to be radially aligned with the protrusions of the end pieces so that said securing bands are brought into contact with the protrusions upon surrounding the coil.

18. A combination as claimed in claim 16, characterized in that each end portion of the sleeve is provided with at least one additional notch and that each support and bearing element is provided with a corresponding follower boss arranged on the inside of one of the support arms to be brought into engagement with said additional notch to form a detachable joint so that the drum is prevented from turning in relation to the support and bearing elements.

19. A combination as claimed in claim 18, characterized in that the end pieces consist of laminated plates of fibreboard having a thickness of at least 12 mm.

20. A combination as recited in claim 18 wherein the end pieces comprise pressed fiberboard plates having a thickness of at least 15 mm and a density of 700–950 kg/m$^3$.

21. A tool for detachable assembly on a disposable drum to form a rotatable unit to be placed in journalling equipment for rotation of the unit, said drum comprising: a cylindrical sleeve and two end pieces which are secured to the sleeve to prevent them from slipping axially towards each other; said drum carrying a coil of a continuous flexible object, comprising cable, line, wire, wire cable, rope, cord, ribbon, chain, or the like; said tool comprising two support and bearing elements, each having a hub-forming sleeve, a plurality of support arms rigidly joined to said hub and forming a right angle or substantially a right angle with the central axis of said hub, and a concentric support member which supports and centers said drum by internal engagement with both end portions of said sleeve; a connecting member comprising a shaft arranged to extend through said sleeve and said hubs, and an anchoring which anchors said support and bearing elements to said shaft while at the same time securing said sleeve against axial displacement in relation to said shaft; said support arms positioned to abut in a supporting manner against said end pieces, and having free ends located radially inside the outer circular edge of said end pieces so that said support arms are not in contact with the ground when said unit is resting on the ground by said end pieces of said drum engaging the ground.

* * * * *